US006196095B1

(12) United States Patent
Suter

(10) Patent No.: US 6,196,095 B1
(45) **Date of Patent: *Mar. 6, 2001**

(54) METHOD AND APPARATUS FOR CUTTING CONTINUOUS PAPER WEB

(75) Inventor: Walter Suter, Uitikon-Waldegg (CH)

(73) Assignee: A-Tronic MGM AG, Gotthardstrasse (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/207,506

(22) Filed: Dec. 9, 1998

Related U.S. Application Data

(62) Division of application No. 08/735,451, filed on Oct. 18, 1996, now Pat. No. 5,868,055, which is a continuation of application No. 08/238,056, filed on May 4, 1994, now abandoned.

(30) Foreign Application Priority Data

May 7, 1993 (CH) ..... 1421/93

(51) Int. Cl.[7] ..... B26D 1/06

(52) U.S. Cl. ..... 83/13; 83/613; 83/956; 83/577

(58) Field of Search ..... 83/575, 576, 577, 83/956, 694, 697, 613, 13; 310/17, 19, 28; 318/135

(56) References Cited

U.S. PATENT DOCUMENTS

| | | | |
|---|---|---|---|
| 1,929,007 | | 10/1933 | Turner . |
| 2,603,289 | | 7/1952 | Horton . |
| 3,375,380 | | 3/1968 | Davis . |
| 3,491,279 | | 1/1970 | Rodaway . |
| 3,756,105 | * | 9/1973 | Balamuth et al. . |
| 3,841,185 | | 10/1974 | Baran . |
| 3,954,037 | | 5/1976 | Rios . |
| 4,637,567 | | 1/1987 | Tanaka et al. . |
| 4,671,149 | * | 6/1987 | Makabe et al. . |
| 4,732,068 | | 3/1988 | Yasuda et al. . |
| 4,831,290 | | 5/1989 | Clauss et al. . |
| 5,003,856 | | 4/1991 | Fujimura et al. . |
| 5,063,803 | | 11/1991 | Panneri et al. . |
| 5,163,865 | * | 11/1992 | Smith . |
| 5,195,410 | * | 3/1993 | Young . |
| 5,768,970 | * | 6/1998 | Wolf et al. . |
| 5,862,728 | * | 1/1999 | Giamello . |
| 5,986,381 | * | 11/1999 | Hoen et al. . |

FOREIGN PATENT DOCUMENTS

| | | |
|---|---|---|
| 1 092 241 | 11/1960 | (DE) . |
| 1 915 548 | 10/1969 | (DE) . |
| 2 735 659 | 2/1979 | (DE) . |
| 3 317 521 | 5/1983 | (DE) . |
| 3 317 523 | 5/1983 | (DE) . |
| 36 21791 | 1/1986 | (DE) . |
| 0 203 222 | 12/1987 | (EP) . |
| 482 287 | 12/1975 | (SU) . |
| 1344529 | 10/1987 | (SU) . |

OTHER PUBLICATIONS

IBM Technical Disclosure Bulletin, vol. 19, No. 8, Jan. 1977 R. Mauroschadt et al. Pp 2984–1985.

* cited by examiner

*Primary Examiner*—Kenneth E. Peterson
(74) *Attorney, Agent, or Firm*—Sughrue, Mion, Zinn, Macpeak & Seas, PLLC

(57) ABSTRACT

A continuous paper web is severed transversely in between the transportation cycles at the paper's maximum allowable rate of feed. The transverse cutter device has a stationary bottom blade 6 and a driven upper blade 5 fixed to or integral with a permanent magnet 7*a,* and a linear motor is used as the drive for the upper blade. The motor stator 7*c* is fastened to a carrier 4, and the driven blade undergoes reciprocating or vibratory strokes within a stator slot.

9 Claims, 3 Drawing Sheets

METHOD AND APPARATUS FOR CUTTING CONTINUOUS PAPER WEB

This is a divisional of application Ser. No. 08/735,451 filed Oct. 18, 1996, now U.S. Pat. No. 5,868,055, which is a continuation of Ser. No. 08/238,056 filed May 4, 1994 abandoned, the disclosure of which is incorporated herein by reference.

BACKGROUND OF THE INVENTION

This invention relates to a method and apparatus for cutting continuous webs of paper with advance feed holes, which are fed via a feed, after the advance feed tapes or perforated edge strips have been severed, to a transverse cutter arrangement with a non-driven bottom blade and a driven upper blade.

The continuous paper webs for high speed printers and computer systems are cut into single sheets at fixed or variable rates; the cutter has to function cyclically according to its method of operation. During the cutting procedure the paper stands still. The result is that the paper is stressed up to the vicinity of its limit of elasticity at each start up, because a certain period of time also elapses for the cutting process. The transverse cutter, with which the paper web is severed into individual sheets, has to be operated twice in short succession, so that a perforation between the sheets is severed and/or the forms can be cut to the desired dimension.

If a total cycle time is set at 100 msec. for a gross format of 12", upper blade of the cutter stands still for about 75 msec. and is then moved twice in the remaining 25 msec. However, this means that the upper blade which has to carry out a stroke of about 12 mm, has less than 25 msec for two strokes. That means that the blade would have to be moved at a speed of at least 25 meters average per second, if an acceleration distance and a deceleration distance in the working stroke and again in the return stroke did not also have to be taken into consideration. For this reason the speed has to be set much higher.

To date, the conventional eccentric drives have not improved the situation at these speeds, if the necessary speed is not to be obtained by oversizing.

SUMMARY OF THE INVENTION

An object of the invention is thus to provide a device, with which the continuous paper webs can be severed transversely in between transportation cycles at the paper's maximum allowable rate of feed. This problem is solved according to the invention by using as the drive for the upper blade one of multiple linear motor(s), whose stator (stationary bobbin) is fastened to the carrier for the blade guide, and by designing the blade as a rotor (magnetic plunger) or armature of the linear motor.

In addition, the invention relates to a method of operating the device wherein the linear motor is driven with a small amplitude vibration at least just before the cutting stroke current surge in the exciter winding of the stator, in order to thus move the blade back and forth, and the cutting stroke current surge is triggered at the upper reversal point of the vibration or shortly thereafter.

Linear electromagnetic motors have been known for a long time. Thus, for example, an electric linear motor for limited adjusting movements of magnetic heads is described in DE-C-19 15 548. The problem that had to be solved with it was the immediate stoppage with high braking acceleration when the motor current is interrupted. Thus, this invention is in a distant field. A similar use of a linear motor is described in DE-C 33 17 521 and DE-C-33 17 523. Both documents use a linear motor for the precision adjustment of sound heads, wherein the speed is irrelevant. A detailed description of the advantages and disadvantages of electromagnetic linear motors is set forth in EP-A-0 203 222.

In the present invention a linear motor drive capable of high acceleration is paramount. The precision of the stroke or the space for an eccentric drive is only of secondary importance.

DETAILED DESCRIPTION OF THE PREFERRED EMBODIMENTS

Figure 1:
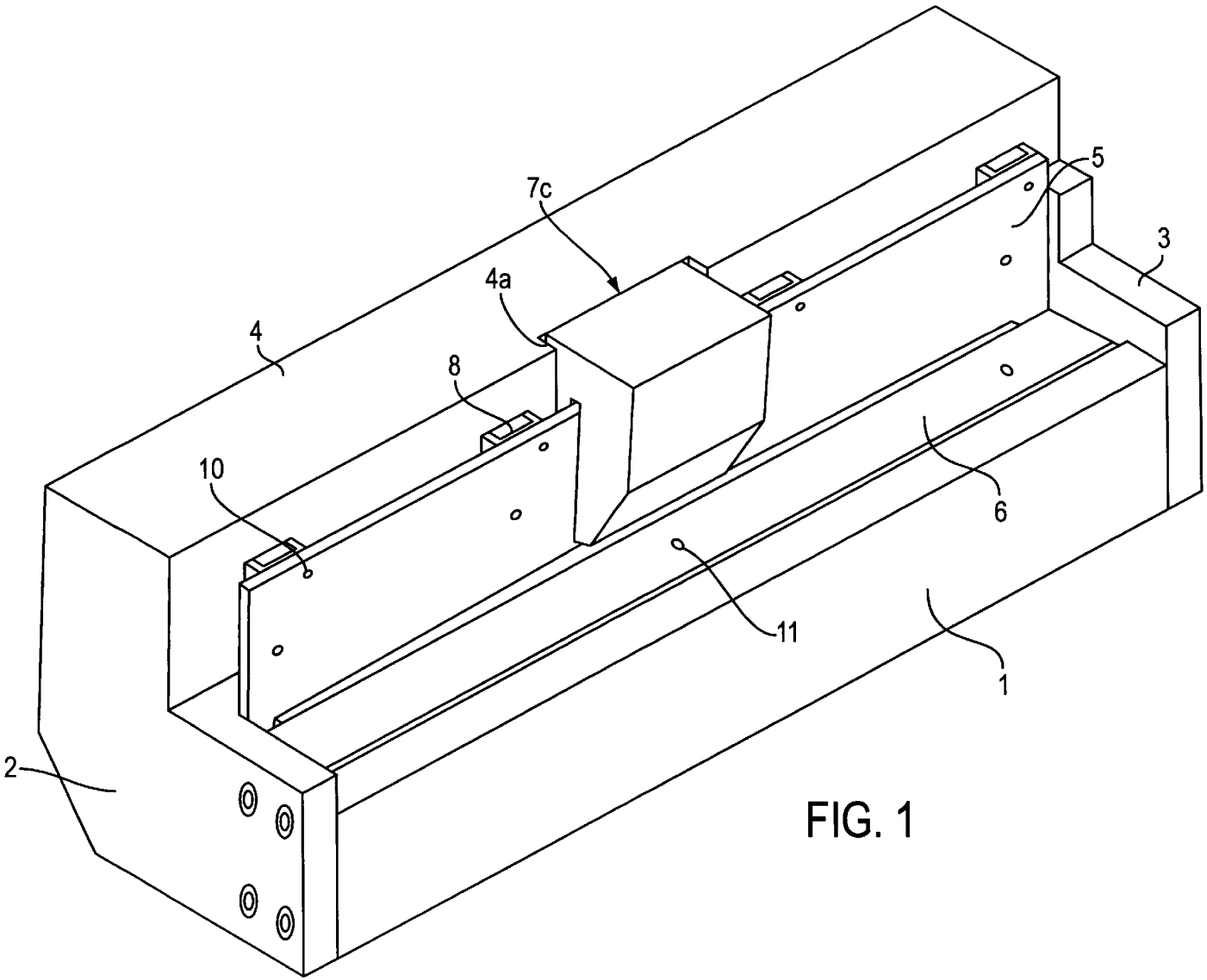
FIG. 1 is a perspective view of a first embodiment of a transverse cutter module according to the invention.
Figure 2:
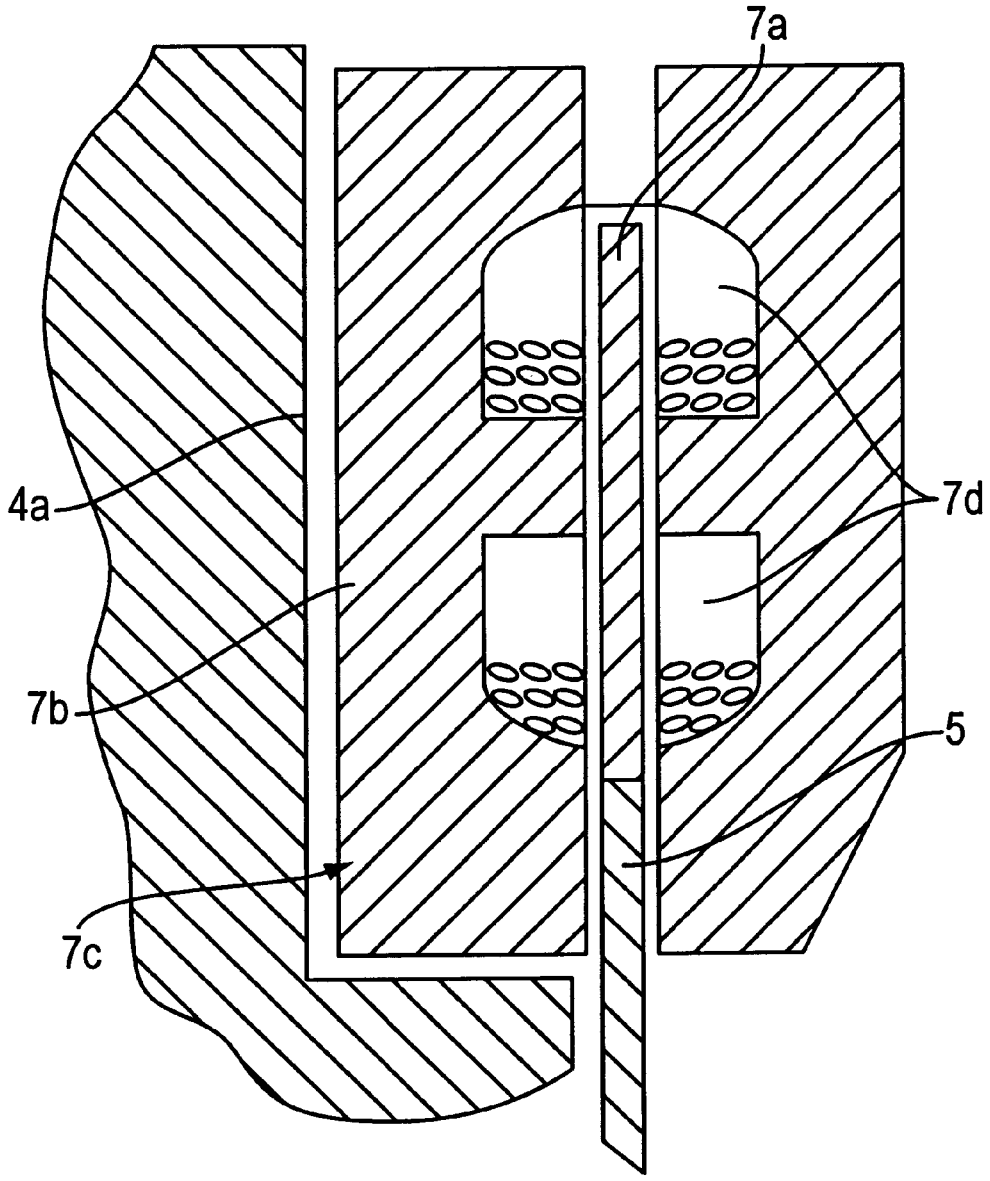
FIG. 2 shows a transverse sectional fragment of the upper blade with stator and armature taken through the middle of FIG. 1.

FIGS. 1 and 2 show a first embodiment with a permanent magnet 7*a* integral with the movable upper blade 5. The upper blade is moved back and forth on a carrier 4 with several guides 8. The bottom, non-driven blade 6 is attached by screws 11 to the bottom section 1. The rear section of a stationary bobbin in the form of a stator 7*c* is disposed in a recess 4*a* in the carrier 4, and is fastened there in a manner not shown in detail. A magnetic coil 7*d* is provided in the stator 7*c,* as shown in FIG. 2. The permanent magnet 7*a,* stator 7*c* and magnetic coil 7*d* comprise the linear motor of this embodiment; the permanent magnet 7*a* with the blade 5 serving as the rotor associated with the stator of the linear motor.

Figure 3:
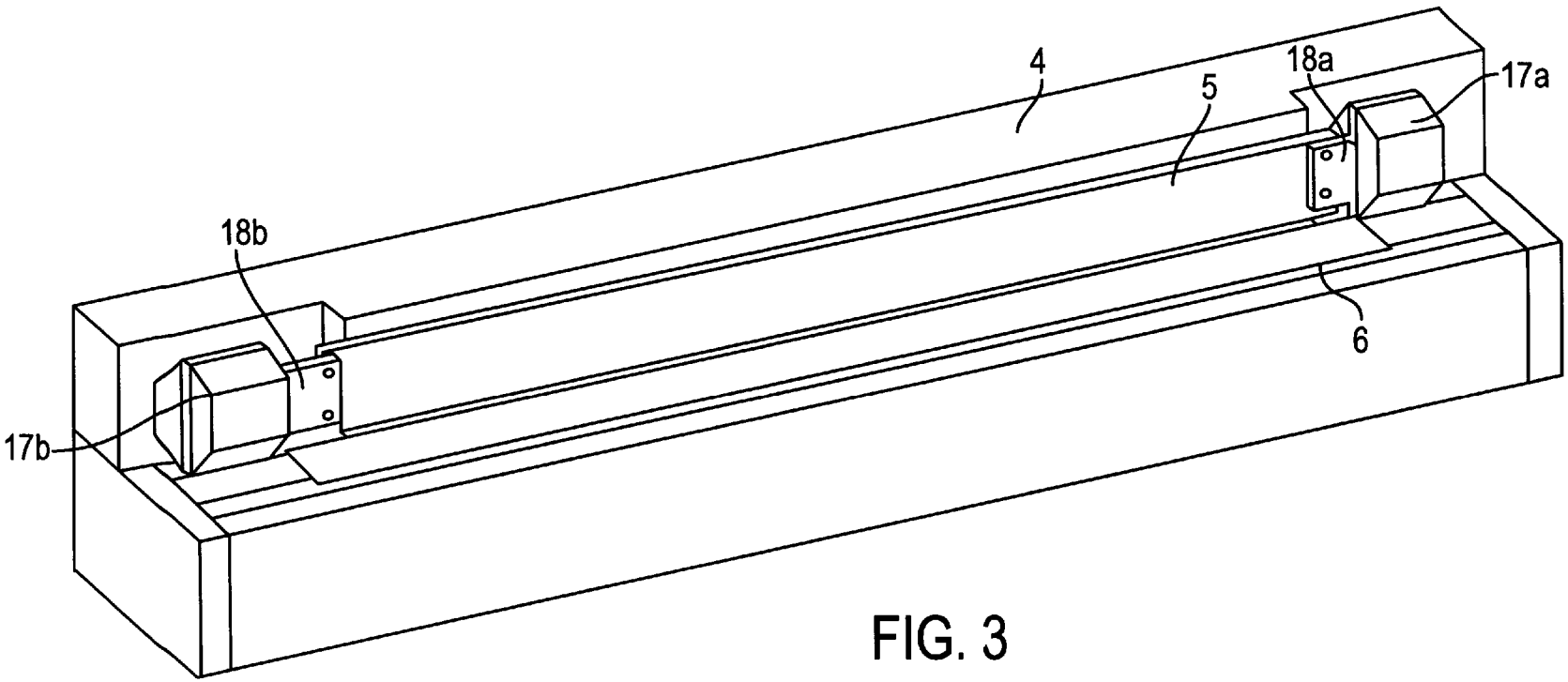
FIG. 3 is a perspective view of a second embodiment of a transverse cutter module.

FIG. 3 shows another embodiment of the invention with an upper, driven blade 5 and a bottom, non-driven blade 6. The opposite ends of the driven blade 5 are fastened to the plungers 18*a* and 18*b* of linear motors 17*a,* 17*b*. Linear motors 17*a* and 17*b* have a similar internal construction as that described with respect to FIG. 2. Instead of having the magnets 18*a* and 18*b* which act as the rotor of the linear motors 17*a* and 17*b* which are separate from the blade 5 and connected to it, the permanent magnets could also be integral with the blade, as shown in FIGS. 1 and 2.

To increase, if necessary, the drive force, it would also be possible to provide more than two linear motors with multiple permanent magnet plungers that are integral with the blade. The overall cutting blade could also comprise a guide member with an integral permanent magnet and an interchangeable cutting edge.

Even if the upper cutter 5 is very light-weight, there is still a mass that has to be accelerated. To this end, the electromagnetic linear motor gives good performance. The entire upper blade can undergo one vibration, which corresponds to or represents a working stroke. Considering that at a frequency w of 1,000 cycles per sec., for example, and a vibration amplitude A of 1 mm, the basic acceleration B that is necessary can be calculated in the following manner:

$$B=w^2 \times A,$$

which becomes:

$$B=1{,}000^2 \times 0.001=10^3 \text{ m/sec}^2.$$

Thus, for the working stroke to function flawlessly with an acceleration of 1,700 m/sec$^2$, only an additional acceleration of 700 m/sec$^2$ has to be generated. Since the entire stroke of the cutter can amount to about 12 mm, one can work with relatively small magnetic forces, so that the permanent magnet 7*a* does not result in too large an additional weight.

What is claimed:

1. A method for cutting a continuous infed paper web in an apparatus comprising a transverse cutter arrangement (5, 6) having a stationary, non-driven bottom blade (6) cooperable with an upper blade (5) which is driven by a linear motor and an armature (7*a,* 5), the armature (7*a,* 5) comprising the upper blade (5), the method comprising the steps of:

a) vibrating the upper blade in a movement back and forth during a period at least until a cutting stroke is applied;

b) holding the infed paper web in a position where a cutting stroke has to be applied; and c) triggering the cutting stroke at one of (A) an upper reversal point of the movement of the upper blade (5), and (B) shortly after an upper reversal point of the movement of the upper blade (5).

2. A method as claimed in claim 1, wherein the linear motor comprises a stator (7*c*) with a magneto coil (7*d*) and an armature (7*a,* 5) interacting with the stator (7*c*), the armature (7*a,* 5) comprising the upper blade (5) and a permanent magnet (7*a*), and wherein the vibration of the upper blade (5) and the execution of the cutting stroke is achieved by applying the required motor currents to the magnetic coil (7*d*) of the stator (7*c*).

3. A method as claimed in claim 1, wherein the frequency of the vibration ranges from 500 to 1500 Hz.

4. A method as claimed in claim 3, wherein the amplitudes of the vibration are on the order of up to 1 mm.

5. A method as claimed in claim 4, wherein the duration of the vibration is in a range of 5 to 10 msec.

6. A method as claimed in claim 3, wherein the cutting stroke is initiated during the vibrating step at one of (A) the point at which the blade reverses directions from travelling away from the paper web to travelling toward the paper web, and (B) shortly thereafter.

7. A method as claimed in claim 3, wherein the stator (7*c*) comprises a magneto coil (7*d*) and the armature (7*a,* 5) comprises the upper blade (5) and a permanent magnet (7*a*), and wherein the vibration of the upper blade (5) and the execution of the cutting stroke is achieved by applying the required motor currents to the magnetic coil (7*d*) of the stator (7*c*).

8. A method as claimed in claim 3, wherein the duration of the vibration is in a range of 5 to 10 msec.

9. A method as claimed in claim 1, further comprising vibrating the blade toward and away from the paper web with an amplitude that is small enough so as to avoid contact between the blade and the paper web.

* * * * *